US006753643B2

(12) United States Patent
Wilson

(10) Patent No.: US 6,753,643 B2
(45) Date of Patent: Jun. 22, 2004

(54) METHOD FOR FORMING UNIFORM SHARP TIPS FOR USE IN A FIELD EMISSION ARRAY

(75) Inventor: Aaron R. Wilson, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 77 days.

(21) Appl. No.: 10/057,351

(22) Filed: Jan. 24, 2002

(65) Prior Publication Data

US 2002/0106960 A1 Aug. 8, 2002

Related U.S. Application Data

(62) Division of application No. 09/537,525, filed on Mar. 29, 2000, which is a division of application No. 09/026,243, filed on Feb. 19, 1998, now Pat. No. 6,171,164.

(51) Int. Cl.[7] ..... H01J 1/02

(52) U.S. Cl. ..... 313/309; 313/336; 313/351; 313/496

(58) Field of Search ..... 313/351, 495, 313/496, 309, 310, 336, 497; 345/55, 75

(56) References Cited

U.S. PATENT DOCUMENTS

| | | | | |
|---|---|---|---|---|
| 4,983,878 | A | | 1/1991 | Lee et al. |
| 5,266,530 | A | | 11/1993 | Bagley et al. |
| 5,302,238 | A | | 4/1994 | Roe et al. |
| 5,302,239 | A | | 4/1994 | Roe et al. |
| 5,318,918 | A | | 6/1994 | Frazier |
| 5,389,026 | A | | 2/1995 | Fukuta et al. |
| 5,391,259 | A | | 2/1995 | Cathey et al. |
| 5,399,238 | A | | 3/1995 | Kumar |
| 5,448,132 | A | * | 9/1995 | Komatsu ..... 313/495 |
| 5,455,196 | A | | 10/1995 | Frazier |
| 5,558,271 | A | | 9/1996 | Rostoker et al. |
| 5,561,328 | A | | 10/1996 | Massingill et al. |
| 5,581,146 | A | * | 12/1996 | Pribat et al. ..... 313/309 |
| 5,595,519 | A | * | 1/1997 | Huang ..... 445/24 |
| 5,627,427 | A | | 5/1997 | Das et al. |
| 5,634,267 | A | | 6/1997 | Farnworth et al. |
| 5,637,539 | A | | 6/1997 | Hofmann et al. |
| 5,779,514 | A | | 7/1998 | Cheng et al. |
| 5,808,408 | A | * | 9/1998 | Nakamoto ..... 313/309 |
| 5,847,496 | A | * | 12/1998 | Nakamoto et al. ..... 313/309 |
| 5,898,258 | A | * | 4/1999 | Sakai et al. ..... 313/309 |
| 5,962,958 | A | * | 10/1999 | Nakamoto ..... 313/309 |
| 5,973,445 | A | * | 10/1999 | Watkins ..... 313/309 |
| 6,274,057 | B1 | | 8/2001 | Sexton et al. |
| 6,326,221 | B1 | | 12/2001 | Lee et al. |
| 6,416,376 | B1 | | 7/2002 | Wilson |

* cited by examiner

*Primary Examiner*—Ashok Patel
(74) *Attorney, Agent, or Firm*—TraskBritt

(57) ABSTRACT

A method of forming emitter tips for use in a field emission array is described. The tips are formed by utilizing a polymer residue that forms during the dry etch sharpening step to hold the mask caps in place on the emitter tips. The residue polymer continues to support the mask caps as the tips are over-etched, enabling the tips to be etched past sharp without losing their shape and sharpness. The dry etch utilizes an etchant including fluorine and chlorine gasses. The mask caps and residue polymer are easily removed after etching by washing the wafers in a wash of deionized water, or Buffered Oxide Etch.

32 Claims, 4 Drawing Sheets

METHOD FOR FORMING UNIFORM SHARP TIPS FOR USE IN A FIELD EMISSION ARRAY

CROSS REFERENCE TO RELATED APPLICATIONS

This application is a divisional of application Ser. No. 09/537,525, filed Mar. 29, 2000, pending, which is a divisional of application Ser. No. 09/026,243, filed Feb. 19, 1998, now U.S. Pat. No. 6,171,164, issued Jan. 9, 2001.

GOVERNMENT RIGHTS

This invention was made with United States Government support under contract No. DABT63-97-C-0001 awarded by the Advanced Research Projects Agency (ARPA). The United States Government has certain rights in this invention.

BACKGROUND OF THE INVENTION

This invention relates generally to field emission displays and, more particularly, to the fabrication of an array of atomically sharp field tips for use in field emission displays.

The manufacture and use of field emission displays is well known in the art. The clarity, or resolution, of a field emission display is a function of a number of factors, including emitter tip sharpness.

One current approach toward the creation of an array of emitter tips is to use a mask to form the silicon tip structure, but not to form the tip completely. Prior to etching a sharp point, the mask is removed or stripped. Next, the tip is etched to sharpness after the mask is stripped from the apex of the tip.

It has been necessary to terminate the etch at or before the mask is fully undercut to prevent the mask from being dislodged from the apex. If an etch proceeds under such circumstances, the tips become lopsided and uneven due to the presence of the mask material along the side of the tip, or the substrate, during a dry etch and, additionally, the apex may be degraded, as shown in FIG. 1. Such a condition also leads to contamination problems because of the mask material randomly lying about a substrate. This mask 30, when dislodged, masks off a region of the substrate 11 where no masking is desired and allows continued etching in places where the masks 30 supposedly protected. This results in randomly placed, undesired structures being etched in the material.

If the etch is continued after the mask is removed, the tip becomes more dull. This results because the etch chemicals remove material in all directions, thereby attacking the exposed apex of the tip while etching the sides. In addition, the apex of the tip may be degraded when the mask has been dislodged due to physical ion bombardment during a dry etch.

Accordingly, current methods perform underetching, which is to stop the etching process before a fine point is formed at the apex of the tip. Underetching creates a structure referred to as a "flat top." An oxidation step is then performed to sharpen the tip. This method results in a non-uniform etching across the array and the tips then have different heights and shapes. Other solutions have been to manufacture tips by etching, but they do not undercut the mask all the way. Furthermore, they do not continue etching beyond full undercut of the mask as this typically leads to degradation of the tip. Rather, they remove the mask before the tip is completely undercut, then sharpen the tips from there. The wet silicon etch methods of the prior art result in the mask being dislodged from the apex of the tip, at the point of full undercut. This approach can contaminate the bath, generate false masking, and degrade the apex.

The non-uniformity among the tips can also present difficulties in subsequent manufacturing steps used in the formation of the display. This is especially so in those processes employing chemical planarization, mechanical planarization, or chemical mechanical planarization. Non-uniformity is particularly troublesome if it is abrupt, as opposed to a graduated change across the wafer.

Fabrication of the uniform wafer of tips using current processes is difficult to accomplish in a manufacturing environment for a number of reasons. For example, simple etch variability across the wafer affects the wafer at the time at which the etch should be terminated with the prior art approach.

Generally, it is difficult to obtain positive etches with definitions better than 5%, with uniformities of 10–20% being more common. This makes the "flat top" of an emitter tip etch using conventional methods vary in size. In addition, the oxidation necessary to "sharpen" or point the tip varies as much as 20%, thereby increasing the possibility of non-uniformity among the various tips in the array.

Tip height and other critical dimensions suffer from the same effects on uniformity. Variations in the masking conformity and material to be etched compound the problems of etch uniformity.

Manufacturing environments require processes that produce substantially uniform and stable results. In the manufacture of an array of emitter tips, the tips should be of uniform height, aspect ratio, sharpness, and general shape with minimal deviations, particularly in the uppermost portion.

In one approach used to overcome the problems illustrated in the prior art, a mask is formed over the substrate before etching begins. The mask has a composition and dimensions that enable it to remain balanced on the apex of the tips until all the tips are substantially the same shape when the etch is performed. This is disclosed in U.S. Pat. No. 5,391,259, issued Feb. 21, 1995, entitled "Method for Forming a Substantially Uniform Array of Sharp Tips." Although this process does achieve a more uniform array of sharp tips, there are still problems with the balancing of the mask on the apex of the tips until all the tips have finished etching and reached sharpness. That is, the uniformity of the mask cannot always be guaranteed and slipping of the mask onto the substrate as illustrated in FIG. 1 still occurs, albeit less frequently. Accordingly, what is needed is a method for maintaining the mask above the apex of the tips in a more secure fashion until the desired uniform sharpness is achieved during the etch process.

SUMMARY OF THE INVENTION

According to the present invention, a method of forming emitter tips for use in a field emission array is disclosed. The tips are formed by utilizing a polymer residue that forms during the dry etch sharpening step to hold the mask caps in place on the apex of the emitter tips. The residue polymer continues to support the mask caps as the tips are overetched, enabling the tips to be etched past sharp without losing their shape and sharpness. The dry etch utilizes an etchant comprised of fluorine and chlorine gasses. The mask caps and residue polymer are stripped after etching by washing the wafers in deionized water.

DETAILED DESCRIPTION OF THE INVENTION

Figure 1:
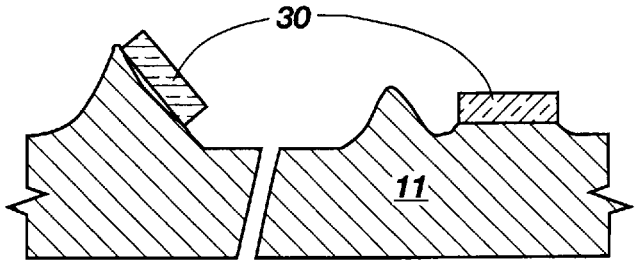
Fig. 1 (PRIOR ART)
FIG. 1 is a cross-sectional schematic drawing of a malformed structure that results when the mask layer is dislodged from the tips of the etch.
Figure 8:
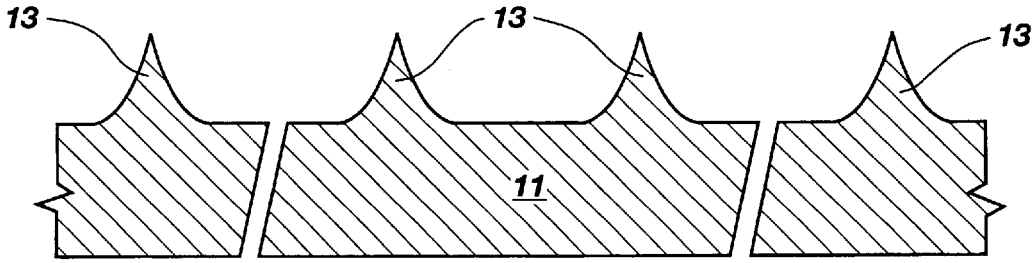
FIG. 8 is a cross-sectional schematic drawing of the structure of FIG. 7, depicting the sharp cathode tip after the etch has been completed and the mask layer has been removed.
Figure 2:
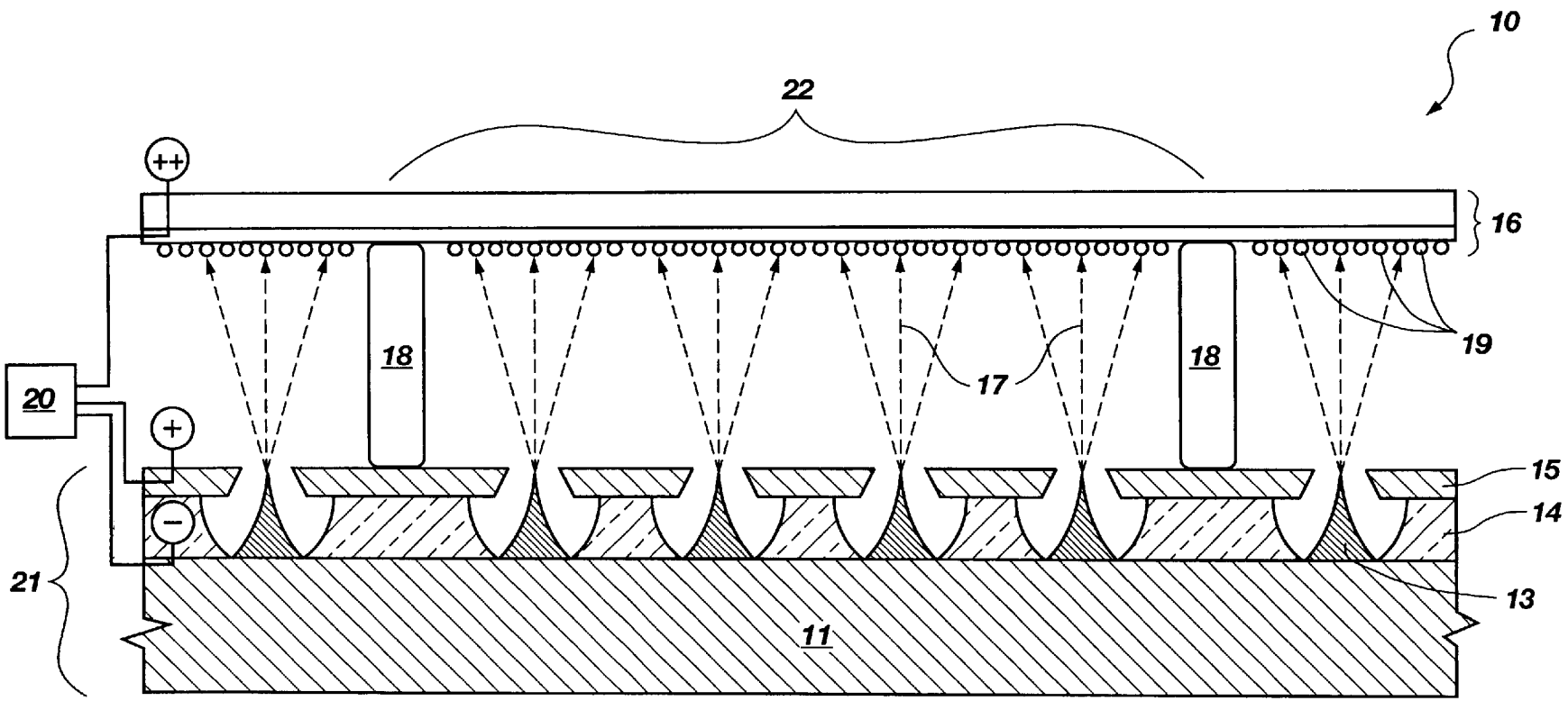
FIG. 2 is a cross-sectional schematic drawing of a pixel of a flat panel display having cathode emitter tips fabricated by the process of the present invention.

A representative portion of a field of emission display 10 is illustrated in FIG. 2. The display 10 includes a display segment 22. Each display segment 22 is capable of displaying a pixel, or a portion of a pixel 19, as, for example, one green dot of a red/green/blue full-color triad pixel. Preferably, a substrate comprised of glass is used and a material that is capable of conducting electric current is present on the surface of the substrate so that it can be patterned and etched to form micro cathodes or electrode emitter tips 13. Amorphous silicon is deposited on the glass substrate to form micro cathodes 13.

At a field emission site, a micro cathode 13 has been constructed on top of the substrate 11. The micro cathode 13 is a protuberance that may have a variety of shapes, such as pyramidal, conical, or other geometry that has a fine micro point for the emission of electrons. Surrounding micro cathodes 13 is a grid structure 15. When a voltage differential, through source 20, is applied between cathodes 13 and grid 15, a stream of electrons 17 is emitted toward a phosphor coated face plate 16. Face plate 16 serves as the anode where pixels 19 are charged by electrons 17.

The electron emission tip 13 is integral with a substrate 11 and serves as the cathode. Grid 15 serves as a grid structure for applying an electrical field potential to its respective cathode 13.

A dielectric insulating layer 14 is deposited on conductive cathode 13, which layer 14 can be formed from the substrate or from one or more deposited films, such as a chromium amorphous silicon bilayer. Insulating layer 14 also has an opening at the field emission site location.

Disposed between face plate 16 and base plate 21 are spatial support structures 18 that function as support atmospheric pressure that exists on the electrode face plate 16. The atmospheric pressure is the result of the vacuum created between the base plate 21 and face plate 16 for the proper functioning of the emitter tips 13.

Base plate 21 comprises a matrix addressable array of cold cathode emitter tips 13, a substrate 11 where tips 13 are formed, insulating layer 14, and anode grid 15.

In the process of the present invention, the mask dimensions, the balancing of the gasses and parameters in the plasma etch enable the manufacturer to determine and significantly control the dimensions of tip 13. Compositions of the mask affects the ability of mask 30 to remain balanced at the apex of the emitter tip 13 and to remain centered on the apex of emitter tip 13 during the over-etching of tip 13. This is achieved by using a combination of gasses that forms a polymer support between the apex of tip 13 and the subsurface of insulating layer 14, rather than merely relying upon mask 30 to balance precariously on the emitter tip 13 during the etching process. Over-etching refers to the time period when the etch process is continued after a substantially full undercut is achieved. Full undercut refers to the point at which the lateral removal of material is equal to the original lateral dimension of the mask 30.

Figure 3:
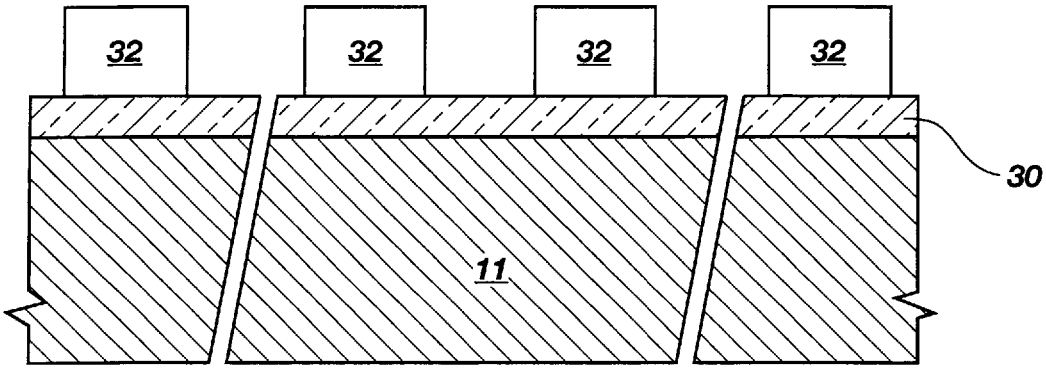
FIG. 3 is a cross-sectional schematic drawing of a substrate in which is deposited or grown a mask layer and a pattern photo resist layer, according to the process of the present invention.

FIG. 3 depicts the substrate 11, which is amorphous silicon overlying glass, polysilicon, or any other material from which emitter tip 13 can be fabricated. Substrate 11 has a mask layer 30 deposited or grown thereon. Mask layer 30 is typically a 0.2 micrometer ($\mu$m) layer of silicon dioxide formed on the substrate 11. Tip geometries and dimensions and conditions for the etch process will vary with the type of materials used to form tips 13.

Mask layer 30 can be made of any suitable materials such that its thickness is great enough to avoid being completely consumed during the etching process, but not so thick as to overcome the adherent forces that maintain it in the correct position with respect to tip 13 throughout the etch process.

A photo resist layer 32, or other protective element, is patterned on mask layer 30 if the desired masking material cannot be directly patterned or applied. When photo resist layer 32 is patterned, the preferred shapes are dots or circles.

Figure 4:
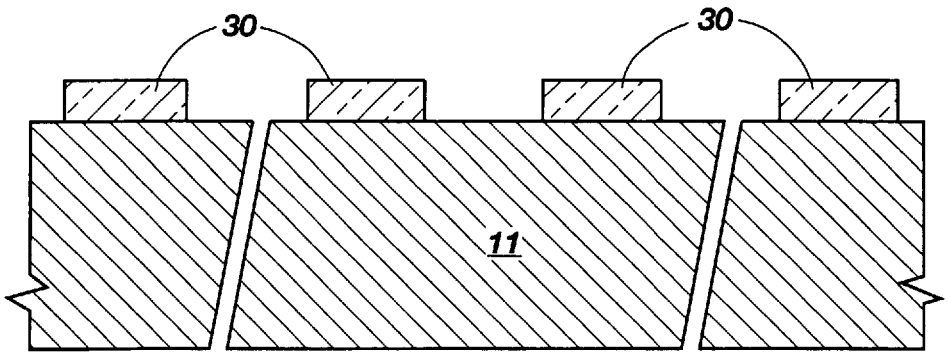
FIG. 4 is a cross-sectional schematic drawing of the structure of FIG. 3, after the mask layer has been selectively removed by plasma dry etch, according to the process of the present invention.

The next step in the process is selective removal of mask 30 that is not covered by photo resist pattern 32 as shown in FIG. 4. The selective removal of mask 30 is accomplished preferably through a wet chemical etch. An aqueous HF solution can be used in a case of a silicon dioxide mask; however, any suitable technique known in the industry may also be employed, including physical removal techniques or plasma removal.

In a plasma etch, the typical etches used to etch the silicon dioxide include, but are not limited to: Chlorine and Fluorine. And typical gasses and compounds include: $CF_4$, $CHF_3$, $C_2F_6$ and $C_3F_8$. Fluorine with oxygen can also be used to accomplish the oxide mask 30 etch step. The etchant gases are selective with respect to silicon and the etch rate of oxide is known in the art, so that the point of the etch step can be calculated.

Figure 5:
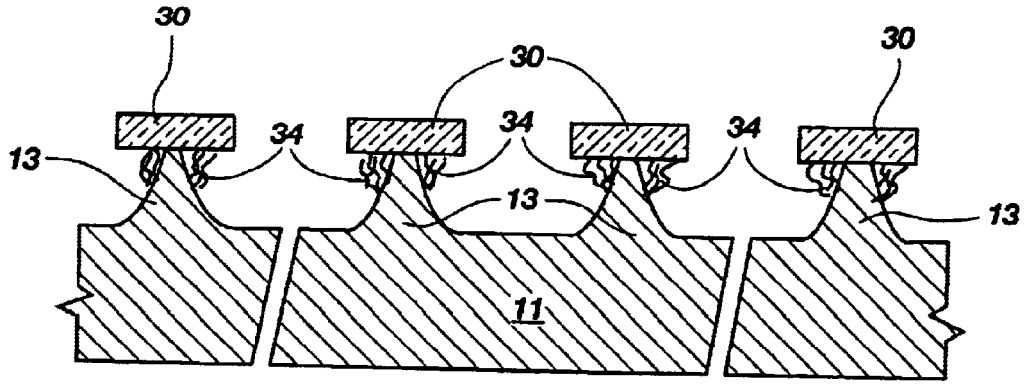
FIG. 5 is a cross-sectional schematic drawing of the structure of FIG. 4, during the etch process of the present invention.

Alternatively, a wet oxide etch can also be preformed using common oxide etch chemicals. At this stage, the photo resist layer 32 is stripped. FIG. 5 depicts the mask 30 structure prior to the silicon etch step.

Figure 6:
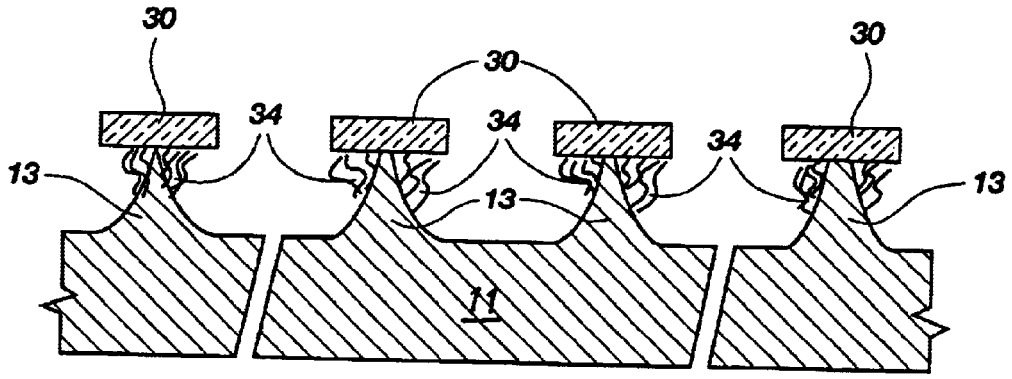
FIG. 6 is a cross-sectional schematic drawing of the structure of FIG. 5, as the etch proceeds according to the process of the present invention, illustrating that some of the tips become sharp before other tips.

A plasma etch, with selectivity to the etch mask 30, is then employed to form tips 13. The plasma contains a fluorinated gas, such as $NF_3$, in combination with a chlorinated gas, such as $Cl_2$, and forms a polymer residue that supports the mask during the etch process. Preferably, the plasma comprises a combination of $NF_3$ and $Cl_2$, and an additive, such as helium. The combination of $NF_3$ and $Cl_2$ is in such a ratio that during the etching process, a polymer 34 is formed underneath mask 30 and on the tip 13. Polymer 34 is used to build a mask support of mask 30 as tip 13 goes from before sharp, shown in FIG. 5, to etch sharp, shown in FIG. 6, and past sharp, shown in FIG. 7. Sharpness is defined as "atomically sharp" and refers to a degree of sharpness that cannot be defined clearly by the human eye when looking at a scanning electron microscope (SEM) micrograph of the structure. The human eye cannot distinguish where the peak of tip 13 actually ends. The measured apex of a sharp tip is typically between 7 Å and 10 Å.

The following are the ranges of parameters for the process as described in the present application. Included is a range of values investigated during the characterization of the process, as well as the range of values that provides the best results for tips 13 that were from 1 μm to 2 μm in height and 1.3 μm to 2.0 μm at the base, with 1.5 μm preferred. One having ordinary skill in the art will realize that the values can be varied to obtain a tip 13 having other height and width dimensions previously stated.

TABLE 1

| Parameters | Investigative Range | Preferred Range |
|---|---|---|
| $Cl_2$: $NF_3$ ratio | 10 to 60% | 30 to 40% |
| $Cl_2$: $NF_3$ | 150–620 SCCM | 290–340 SCCM |
| Helium | 60–250 SCCM | 110–140 SCCM |
| Power | 2500 w | 2500 w |
| Pressure | 5–100 mTorr | 50–70 mTorr |
| Bottom Electrode Power | 0–400 w | 200–300 w |
| Spacing Time | 1.5–3.5 min | 140–150 seconds |
| Temperature | 15–70° C. | 35–45° C. |

Experiments were conducted on a LAM continuum etcher with enhanced cooling. The lower electrode was maintained substantially in the range of 40° C. The etched time that received the best results was between 140–150 seconds with 145 seconds being optimal.

The use of the polymer 34 created during the etching allows the tips to achieve an aspect ratio of 2.5–3.2 using the preferred parameter ranges. Aspect ratio=downward etch rate/undercut etch rate.

The ability to etch to its conclusion past full undercut with minimal changes to the functional shape between the first tip 13 to become sharp and the last tip to become sharp provides a process in which all of the tips in the array are essentially identical in characteristics. Tips of uniform height and sharpness are carefully selected based on the ratio of $NF_3$ to $Cl_2$ used during the mask etch step. This is important in that the combination of $NF_3$ to $Cl_2$ forms the polymer 34 that provides support for mask 30 during the etching of emitter tips 13.

Figure 7:
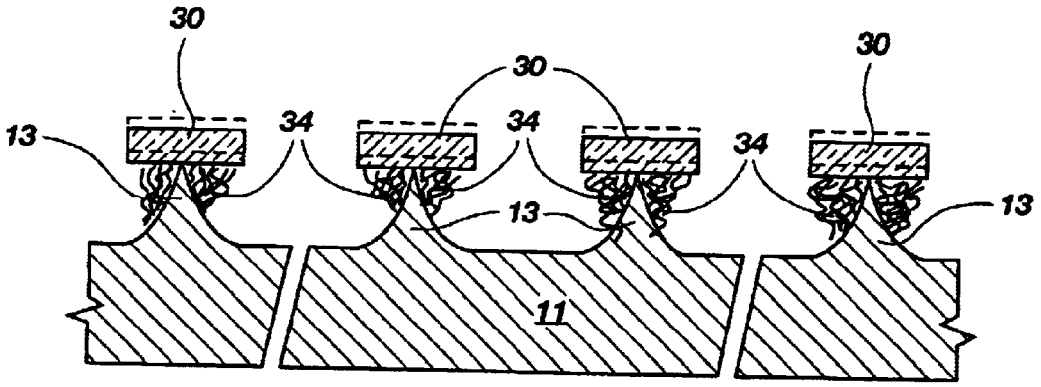
FIG. 7 is a cross-sectional schematic drawing of the structure of FIG. 6, as the etch proceeds toward the process of the present invention.

After the array of emitter tips 13 has been fabricated, the oxide mask layer 30 can be removed along with the polymer layer 34. This is illustrated in FIG. 7. Mask layer 30 and polymer 34 are stripped off by a simple wet etch utilizing deionized water, or a Buffered Oxide Etch. As the mask layer has been etched away from each tip 13, no harsh chemicals need to be used during a subsequent etch removal of mask layer 30.

Ideally, the $NF_3$—$Cl_2$ gas is provided at 310 SCCMs while the helium gas is provided at 125 SCCMs during etching.

The yield of tips results in a uniformity of 20%, or within plus or minus 10%, of the average height and shape for each tip 13. Further, the yield is improved such that a fewer number of tips per pixel are necessary as more and more useful tips are provided. Additionally, with the more-uniform height and sharpness, the turn-on voltage during operation of a field emission display can be lowered. Further, the number of shorter tips that are much shorter than the dimension desired are greatly reduced or eliminated, which means shorting to the grid is also reduced or eliminated.

While the particular process for forming sharp emitter tips to use in flat panel displays as herein shown and disclosed in detail is fully capable of obtaining the desired effects stated above, it is to be understood that it is to be illustrated as the presently preferred embodiments of the invention and that no limitations are intended to the details of construction or design herein shown other than as described in the depending claims. For example, the process of the present invention was discussed with regards to the fabrication of uniform arrays of sharp emitter tips and flat panel displays; however, one of ordinary skill in the art will realize that such a process can be applied to other field ionizing and election emitting structures, and to micro-machining of structures in which it is desired to have a sharp point, such as a probe tip or other device.

What is claimed is:

1. A field emission display comprising:

a face plate, serving as an anode;

a base plate juxtaposed to said face plate and having a substrate surface;

a matrix-addressable array of cold cathode emission emitter tips having atomically sharp apexes typically between 7 Å and 10 Å, formed from said substrate surface, and fabricated according to the process comprising:

masking said substrate surface with a mask;

etching said masked substrate surface to form an array of sharp tips;

forming a support upon each of said sharp tips to support said mask on at least one of said sharp tips, thus preventing said mask from collapsing onto said tips or onto said substrate; and removing said mask and said supports.

2. The field emission display according to claim 1, wherein said mask is balanced among a majority of tips of said array with said supports until substantially uniform sharpness of said tips is achieved.

3. The field emission display according to claim 1, wherein said mask is patterned as an array of circles.

4. The field emission display according to claim 3, wherein said circles have diameters of approximately 1.5 μm.

5. The field emission display according to claim 1, wherein said etching continues on any of said tips that become sharp until substantially a majority of said tips are sharp.

6. The field emission display according to claim 1, wherein said etching utilizes a dry etchant comprised of a fluorine gas and a chlorine gas to form a residue polymer for said forming said supports.

7. The field emission display according to claim 6, wherein said fluorine gas is comprised of $NF_3$.

8. The field emission display according to claim 6, wherein said chlorine gas is comprised of $Cl_2$.

9. The field emission display according to claim 6, wherein said chlorine gas and said fluorine gas are provided in a range of 10%–60% chlorine gas.

10. The field emission display according to claim 7, wherein said fluorine gas ranges from 30%–40% said $NF_3$.

11. The field emission display according to claim 6, wherein said dry etchant further comprises an inert gas.

12. The field emission display according to claim 6, wherein said dry etchant is provided in a range of from 290–340 SCCM.

13. The field emission display according to claim 11, wherein said inert gas is provided in a range of from 60–250 SCCM.

14. The field emission display according to claim 1, wherein said etching is performed for 130–150 seconds.

15. The field emission display according to claim 1, wherein said etching is performed at a temperature in the range of from 35–45° C.

16. The field emission display according to claim 1, wherein said etching is performed for 145 seconds at 40° C. to form a residue polymer on each of said tips and underneath said mask for said forming said supports.

17. A field emission display comprising:

a face plate for serving as an anode;

a base plate located adjacent to said face plate and having a substrate surface;

a matrix-addressable array of cold cathode emission emitter tips having atomically sharp apexes typically between 7 Å and 10 Å, formed from said substrate surface, and fabricated by a process comprising:

masking said substrate surface with a mask;

etching said masked substrate surface to form an array of sharp tips;

forming a support upon each of said sharp tips to support said mask on at least one of said sharp tips, thus preventing said mask from collapsing onto said tips or onto said substrate; and removing said mask and said supports.

18. The field emission display according to claim 17, further comprising:

balancing said mask among a majority of tips of said array with said supports until substantially uniform sharpness of said tips is achieved.

19. The field emission display according to claim 17, wherein said mask is patterned as an array of circles.

20. The field emission display according to claim 19, wherein said circles have diameters of approximately 1.5 $\mu$m.

21. The field emission display according to claim 17, wherein said etching continues on any of said tips that become sharp until substantially a majority of said tips are sharp.

22. The field emission display according to claim 17, wherein said etching utilizes a dry etchant comprised of a fluorine gas and a chlorine gas to form a residue polymer for said forming said supports.

23. The field emission display according to claim 22, wherein said fluorine gas is comprised of $NF_3$.

24. The field emission display according to claim 22, wherein said chlorine gas is comprised of $Cl_2$.

25. The field emission display according to claim 22, wherein said chlorine gas and said fluorine gas are provided in a range of 10%–60% chlorine gas.

26. The field emission display according to claim 23, wherein said fluorine gas ranges from 30%–40% said $NF_3$.

27. The field emission display according to claim 22, wherein said dry etchant further comprises an inert gas.

28. The field emission display according to claim 22, wherein said dry etchant is provided in a range of from 290–340 SCCM.

29. The field emission display according to claim 27, wherein said inert gas is provided in a range of from 60–250 SCCM.

30. The field emission display according to claim 17, wherein said etching is performed for 130–150 seconds.

31. The field emission display according to claim 17, wherein said etching is performed at a temperature in the range of from 35–45° C.

32. The field emission display according to claim 17, wherein said etching is performed for 145 seconds at 40° C. to form a residue polymer on each of said tips and underneath said mask for said forming said supports.

* * * * *